US006619652B2

(12) United States Patent
Belec

(10) Patent No.: US 6,619,652 B2
(45) **Date of Patent: *Sep. 16, 2003**

(54) METHOD AND APPARATUS FOR SEPARATING A COLLATION FROM A SUPPLY STACK

(75) Inventor: Eric A Belec, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/218,929

(22) Filed: Aug. 13, 2002

(65) Prior Publication Data

US 2002/0185803 A1 Dec. 12, 2002

Related U.S. Application Data

(63) Continuation of application No. 09/750,929, filed on Dec. 28, 2000, now Pat. No. 6,502,812.

(51) Int. Cl.[7] ..... B65H 1/26

(52) U.S. Cl. ..... 271/82; 271/314; 271/204; 270/52.02; 270/58.31; 414/796.2

(58) Field of Search ..... 271/314, 82, 204; 270/52.01, 520.02, 52.03, 52.14, 58.31; 414/795.6, 795.9, 796.2

(56) References Cited

U.S. PATENT DOCUMENTS 4,637,598 A * 1/1987 Bouwens et al. ..... 271/3.04
4,934,685 A * 6/1990 Shifley ..... 271/35
4,939,888 A * 7/1990 Katz et al. ..... 53/411
5,017,085 A * 5/1991 Ishikawa ..... 414/796
5,062,599 A * 11/1991 Kriegel et al. ..... 271/35
5,156,384 A * 10/1992 Donahue ..... 270/58.31
5,245,547 A 9/1993 Ramsey ..... 270/58
5,685,533 A 11/1997 Hartsoe ..... 271/10

* cited by examiner

*Primary Examiner*—Patrick Mackey
(74) *Attorney, Agent, or Firm*—Michael J. Cummings; Charles R. Malandra, Jr.; Angelo N. Chaclas

(57) ABSTRACT

An arrangement for separating an entire collation of individual sheets from a supply stack for downstream processing. The arrangement includes a supply stack tray for containing the supply stack while the collations in the supply stack are being separated; a separator device positioned adjacent to the supply stack tray for separating a corner of each sheet of the collation from the supply stack; a deflector positioned adjacent to an edge of the collation for deflecting the collation from the supply stack after the collation has been separated by the separator; and a gripper device positioned in a plane proximate to the first sheet in the collation for gripping the entire collation after the collation has been deflected from the supply stack and for moving the entire collation downstream for processing.

7 Claims, 6 Drawing Sheets

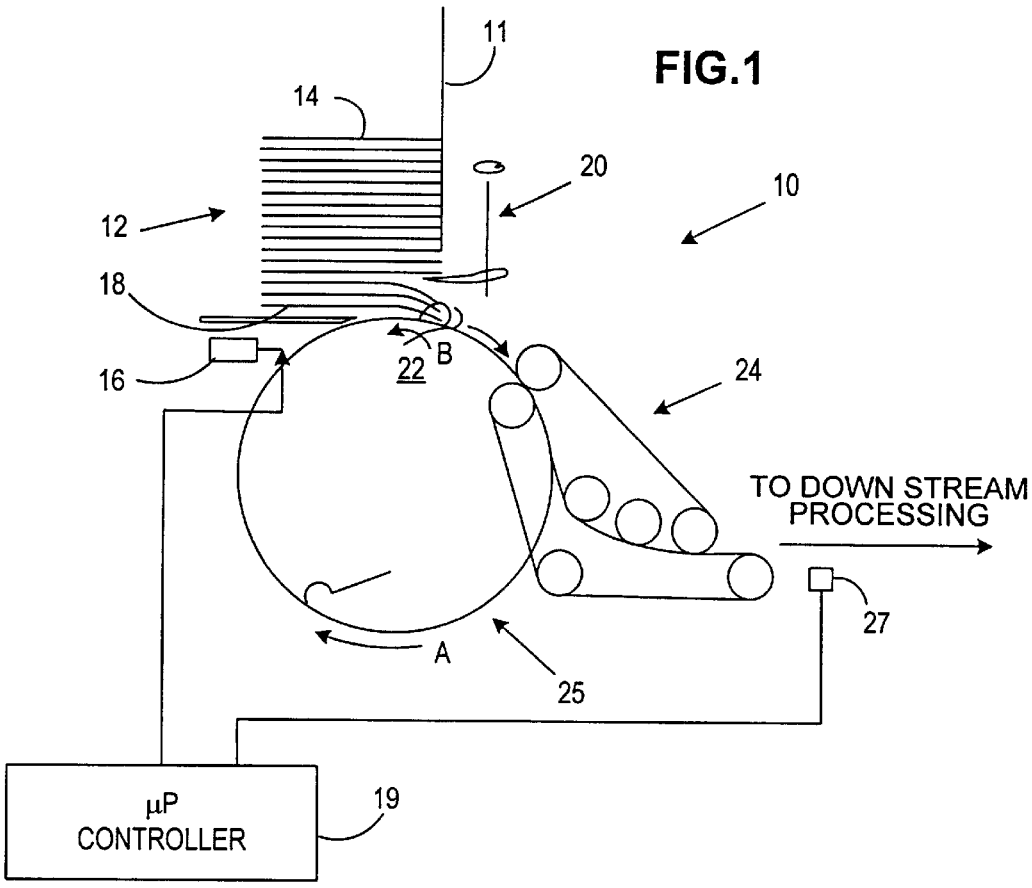
FIG.1A
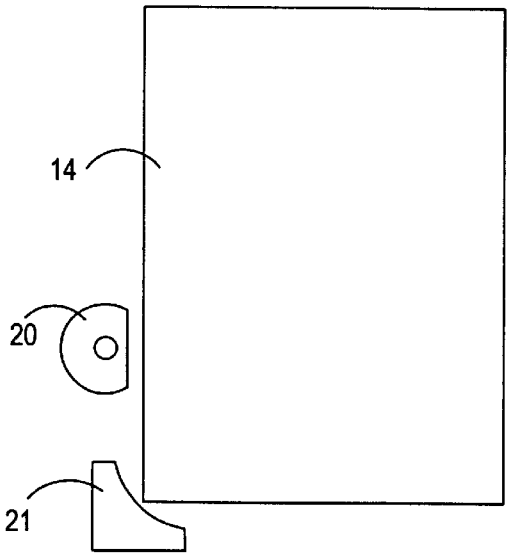

METHOD AND APPARATUS FOR SEPARATING A COLLATION FROM A SUPPLY STACK

This application is a continuation of Application No. 09/750,929 filed on Dec. 28, 2000, the current status of Application No. 09/750,929 is that it has now issued as U.S. Pat. No. 6,502,812.

FIELD OF THE INVENTION

The invention disclosed herein relates generally to an apparatus for separating sheets from a stack and, more particularly, to an apparatus and method for identifying a collation and separating the entire collation from a stack.

BACKGROUND

It is known to be desirable in the paper handling art to provide paper handling apparatus with mechanisms known as accumulators, which accumulate a sequence of sheets being processed by the apparatus to form a stack, or accumulation, for further processing. For example, a sequence of sheets might be fed to a printer for printing of predetermined information, and the output of the printer fed in seriatim to an accumulator where a predetermined number of sheets in the sequence would be accumulated, and the resulting accumulation passed on for further processing, such as folding and insertion into an envelope.

An input subsystem associated with any insertion system typically includes separation of sheets from a primary source such as, e.g., through sheet feeding, bursting, or cutting, and then transport of those sheets at very high-speed into an accumulating device. As the cycle rates of these systems have been required to increase, so have the velocities, accelerations, and decelerations of each sheet that is processed. Prior art involves the separation and linear transport of each sheet into an accumulator, then after the specified number of sheets has been assembled into a collation, the collation is removed from the accumulator in a linear fashion at high-speed so that the collations can be assembled as quickly as possible.

Thus, one of the problems of the prior art is that it requires high-speed manipulations to accumulate a collation. Another problem of the prior art is that high-speed manipulation can be costly. Another problem of the prior art is that high-speed manipulation can be mechanically complex. Still another problem of the prior art is that high-speed manipulation can be noisy. Yet another problem of the prior art is that high-speed manipulation can require unnatural paper motions.

SUMMARY OF THE INVENTION

The present invention does not require high-speed manipulation of individual sheets to accumulate collations. Instead of processing the sheets seritatim at very high velocities, the individual sheets are identified as part of a collation and separated as a collation while they are still in their original, sheet-feeding stack. That is, rather than separating each sheet from the stack and re-accumulating the sheets for collation processing, collations are removed from the supply stack and processed as a whole. This reduces the need for high-speed transports and accumulating techniques. Although the example cited above refers to a typical sheet feeding application, this technique can also be applied to high-speed cutting and bursting applications in which cut/burst sheets are accumulated in a stack for subsequent feeding.

This invention overcomes the disadvantages of the prior art by providing a method and apparatus for identification and separation of an entire collation from a supply stack. This is in contrast to conventional processing techniques that entail separation of singular sheets from a supply stack, and their transport and accumulation at high linear velocities. Thus, the present invention affords for more efficient and higher reliability collation processing. The present invention is directed to, in a general aspect, an apparatus and method for separating an entire collation of individual sheets from a supply stack for downstream processing. The apparatus generally comprises: a supply stack tray for containing the supply stack while the collations in the supply stack are being separated; a separator device positioned adjacent to the supply stack tray for separating a corner of each sheet of the collation from the supply stack; a deflector positioned adjacent to an edge of the collation for deflecting the collation from the supply stack after the collation has been separated by the separator; and a gripper device positioned in a plane proximate to the first sheet in the collation for gripping the entire collation after the collation has been deflected from the supply stack and for moving the entire collation downstream for processing. The method for separating a collation of individual sheets from a supply stack comprises, generally, the steps of separating a corner of each of the individual sheets in the collation from the supply stack; deflecting the collation from the supply stack; and gripping the entire collation and moving the entire collation from the supply stack for downstream processing.

The undesirable aspects of conventional sheet processing and accumulating techniques are readily apparent when associated sheet velocities, accelerations, and decelerations are considered. The present inventions provides a way to reduce associated paper motions, e.g., velocities, accelerations, and decelerations, enhance system reliability and cost aspects, as well as minimize acoustic noise. By eliminating the need to separate and transport each sheet seriatim into an accumulating station (at velocities which could exceed 300 inches per second (ips) for high-speed inserting applications) advantages can be gained.

Thus, an advantage of the present invention is that it reduces the paper manipulations and velocities required to generate a collation. Another advantage of the present invention is that it provides a collation accumulating process that can enhance the performance, cycle rate, cost, and overall reliability of down stream processing devices such as statement generation and processing devices of an inserter. Another advantage of the present invention is that it can replace conventional methods associated with high-speed sheet processing and associated accumulation techniques. Other advantages of the invention will be obvious and will in part be apparent in part from the specification. The aforementioned advantages are illustrative of the advantages of the various embodiments of the present invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 1 is a schematic representation of an embodiment of the apparatus of the present invention where the stack is fed from the bottom in a horizontal orientation.

FIG. 1A is a top view of the schematic representation of FIG. 1.

DETAILED DESCRIPTION OF THE PREFERRED EMBODIMENTS

Figure 2:
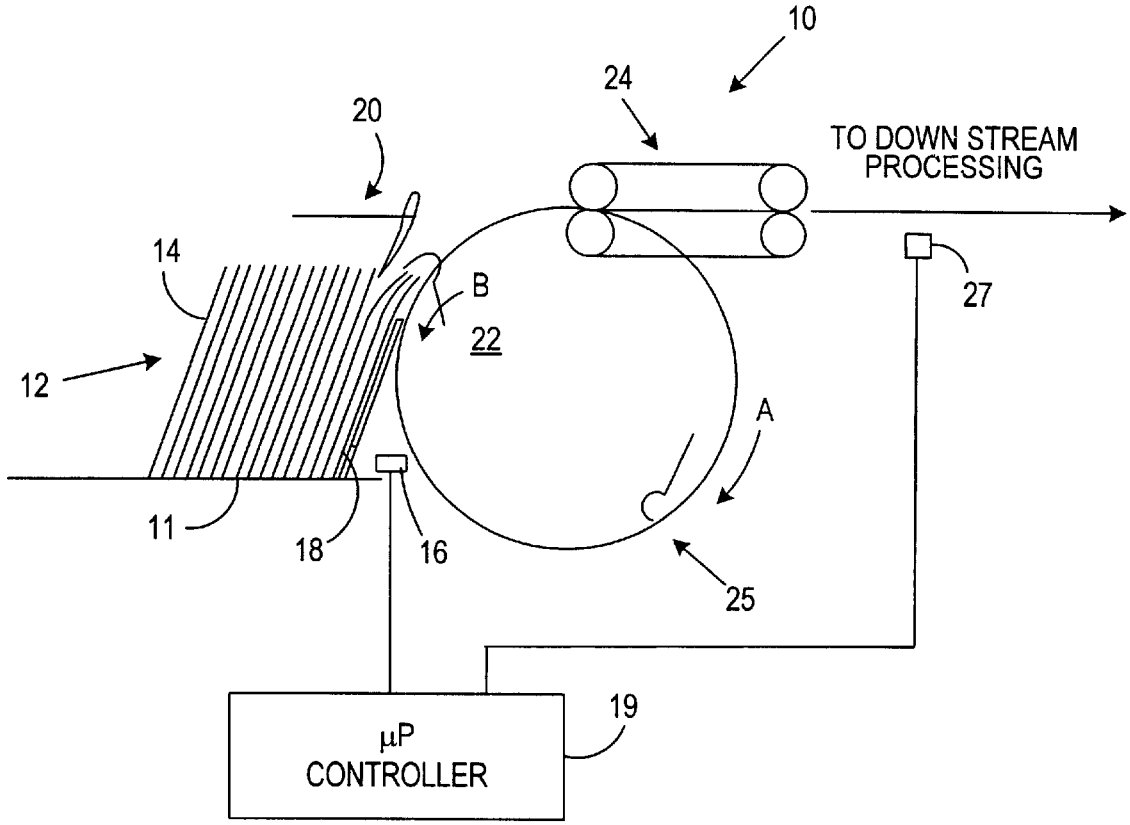
FIG. 2 is a schematic representation of an embodiment of the apparatus of the present invention where the stack is fed in a vertical orientation.

In describing present invention, reference will be made herein to FIGS. 1–5 of the drawings in which like numerals refer to like features of the present invention.

FIG. 1 is a schematic representation of an embodiment of the apparatus 10 of the present invention where the stack is fed from the bottom in a horizontal orientation. A sheet supply stack 12 in stack tray 11 supplies sheets 14 for collation and separation. A scanner 16 reads identifying information, which is commonly referred to as control document information, from a bottom most sheet 18 in sheet supply stack 12. The identifying information, which typically is encoded (for example a bar code) on at least the first sheet of the collation, includes the number of sheets in the collation. The information is sent to a microprocessor controller 19, which coordinates the operation of the components of apparatus 10 in the processing of the collation. A corner separation device 21 (FIG. 1A) located at a corner of the sheet supply stack separates and deflects the corner of each sheet's lead edge downward as the sheet is counted and recognized. Corner separation device 21 of this and other embodiments described herein could be a corner separation device such as a device found on sheet and currency counting devices which operate using a vacuum force. Corner separation device 21 separates and deflects the corners of the sheets of the collation based upon the identifying information obtained by the scanner 16 and furnished to the microprocessor controller 19. Once the corner separation device separates the corners of the sheets of the collation, an auger collation deflection mechanism 20 biases the leading edge of the entire collation downward after the required number of sheets has been counted and separated (this will effectively identify and separate the first collation from all others). Auger collation deflection mechanism 20 of this and other embodiments described herein could be a mechanism that is commonly found in envelope manufacturing equipment, which deflects the lead edge of an envelope blank which in a feeder. Such a mechanism is used in the envelope manufacturing equipment of Winkler Dunnerieier of Germany.

A gripper drum, generally referred to as 25, includes a collation extraction device 22 that grips the leading edge of the deflected sheets of the collation and pulls them from the supply stack as a complete collation. Arrow A shows the direction of movement of the gripper drum 25 and arrow B shows the direction of movement of collation extraction device 22. Gripper drum 25 of this and other embodiments of the present invention described herein, is a continuous motion (rotating) drum with counter rotating gripper devices 22. Typically, gripper drums are used in high-speed bindery equipment. Gripper drum 25 with its collation extraction devices 22 grips the leading edge of the deflected sheets that comprise each collation, pulls them from the supply stack (as a complete collation) and deposits the collation for further downstream processing. In the preferred embodiment, gripper drum delivers the entire collation to a takeaway belt device 24 whereat collation extraction device 22 disengages and allows takeaway belt device 24 to transport the collation downstream for further processing, for example to the folder device (not shown).

Also shown in FIG. 1 is an optional confirmation scanner 27 that may be used to confirm the integrity of the collation processing of the present invention. Such scanner reads the identifying information that was scanned upstream by scanner 16 and sent to controller 19. Controller 19 verifies that each collation has the same bottom most sheet scanned by scanner 27 as was scanned by scanner 16.

FIG. 2 is a schematic representation of an embodiment of the apparatus 10 of the present invention where the stack is fed in a vertical orientation. The sheet supply stack 12 in stack tray 11 supplies sheets 14 for collation and separation. The scanner 16 reads the identifying information from first sheet 18 in the sheet supply stack. The identifying information includes the number of sheets in the collation. The information is sent to the microprocessor controller 19, which coordinates the operation of the components of apparatus 10 in the processing of the collation. The corner separation device (not shown but similar to that in FIG. 1A) located at a corner of the sheet supply stack separates and deflects the corner of each sheet's leading edge downward as the sheet is counted and recognized. The corner separation device separates and deflects the corners of the sheets of the collation based upon the identifying information obtained by the scanner 16 and furnished to the microprocessor controller 19. Once the corner separator separates the corners of the sheets of the collation, auger collation deflection mechanism 20 biases the leading edge of the entire collation downward after the required number of sheets have been counted and separated (effectively identifying and separating the first collation from all others). Gripper drum 25 with its collation extraction device 22 grips the leading edge of the deflected sheets of the collation and pulls them from the supply stack as a complete collation. Arrow A shows the direction of movement of gripper drum 25 and Arrow B shows the direction of movement of collation extraction device 22. Gripper drum 25 with its collation extraction devices 22 grips the leading edge of the deflected sheets that comprise each collation, pulls them from the supply stack 12 (as a complete collation) and disengages the collation for further downstream processing. In this embodiment, gripper drum delivers the entire collation to a takeaway belt device 24 whereat collation extraction device 22 disengages and allows takeaway belt device 24 to transport the collation downstream for further processing, for example to the folder device (not shown).

Also shown in FIG. 2 is an optional confirmation scanner 27 that may be used to confirm the integrity of the collation processing of the present invention. Such scanner reads the identifying information that was scanned upstream by scanner 16 and sent to controller 19. Controller 19 verifies that each collation has the same bottom most sheet scanned by scanner 27 as was scanned by scanner 16.

As an alternative in the embodiments of FIGS. 1 and 2, the sheet supply stack could be continuously automatically reloadable, such as for high-speed applications.

Figure 3:
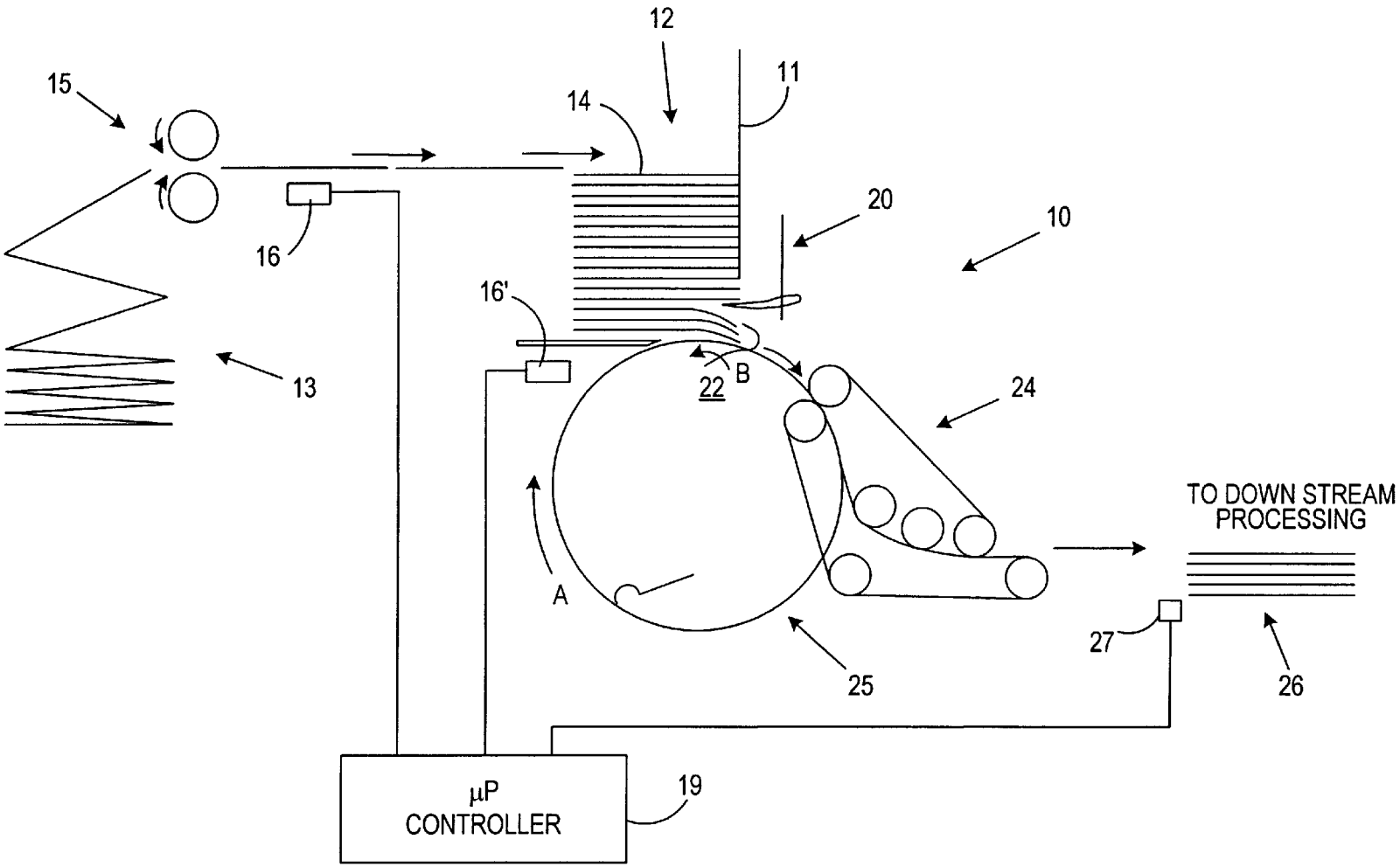
FIG. 3 is a schematic representation of an embodiment of the apparatus of the present invention where the stack is fed from a web material.

FIG. 3 is a schematic representation of an embodiment of the apparatus 10 of the present invention where the sheet supply stack 12 comprises sheets separated from web material 13 such as, for example, fanfold paper (shown) or rolled continuous feed paper (not shown). The web material 13 is fed to a cutter or burster 15 to form individual sheets 14 which are fed to stack tray 11 to form the sheet supply stack 12. The cutter or burster 15 can be a high-speed device which would provide singular sheets to the continuously reloadable sheet supply stack device 12. Scanner 16 reads collation identifying information from the sheets 14. Typically, the identifying information, which includes the number of sheets in the collation, printed on the first sheet of each collation. The identifying information is sent to a microprocessor controller 19, which coordinates the operation of the components of apparatus 10 in the processing of the collation. While the scanner 16 is shown after cutter or burster 15, the scanner could be positioned either before or after the cutter or burster 15, or at stack 12 (shown as 16'). Stack tray 11 functions as a refeed buffer from which sheet supply stack 12 supplies sheets 14 for collation and separation. A corner separation device (not shown shown but similar to that in FIG. 1A) located at a corner of the sheet supply stack separates and deflects the corner of each sheet's leading edge downward as the sheet is counted and recognized. The corner separation device separates and deflects the corners of the sheets of the collation based upon the identifying information obtained by the scanner 16 and furnished to the microprocessor controller 19. Once the corner separator separates the corners of the sheets of the collation, auger collation deflection mechanism 20 biases the leading edge of the entire collation downward after the required number of sheets have been counted and separated (effectively identifying and separating the first collation from all others). Gripper drum 25 with its collation extraction device 22 grips the leading edge of the deflected sheets of the collation and pulls them from the supply stack as a complete collation. Arrow A shows the direction of movement of gripper drum 25 and Arrow B shows the direction of movement of collation extraction device 22. Gripper drum 25 with its collation extraction devices 22 grips the leading edge of the deflected sheets that comprise each collation, pulls them from supply stack 12 (as a complete collation) and disengages the collation for further downstream processing. The gripper drum collation extraction device 22 delivers the entire collation to the takeaway belt device 24. At that point, the gripper drum collation extraction device 22 disengages the entire collation and allows the takeaway belt device 24 to transport the entire collation for downstream processing such as, for example to a folder device (not shown). At station 26, verification scanning can be performed. Optional confirmation scanner 27 may be used to confirm the integrity of the collation processing of the present invention as set forth in the previous embodiments.

Figure 4:
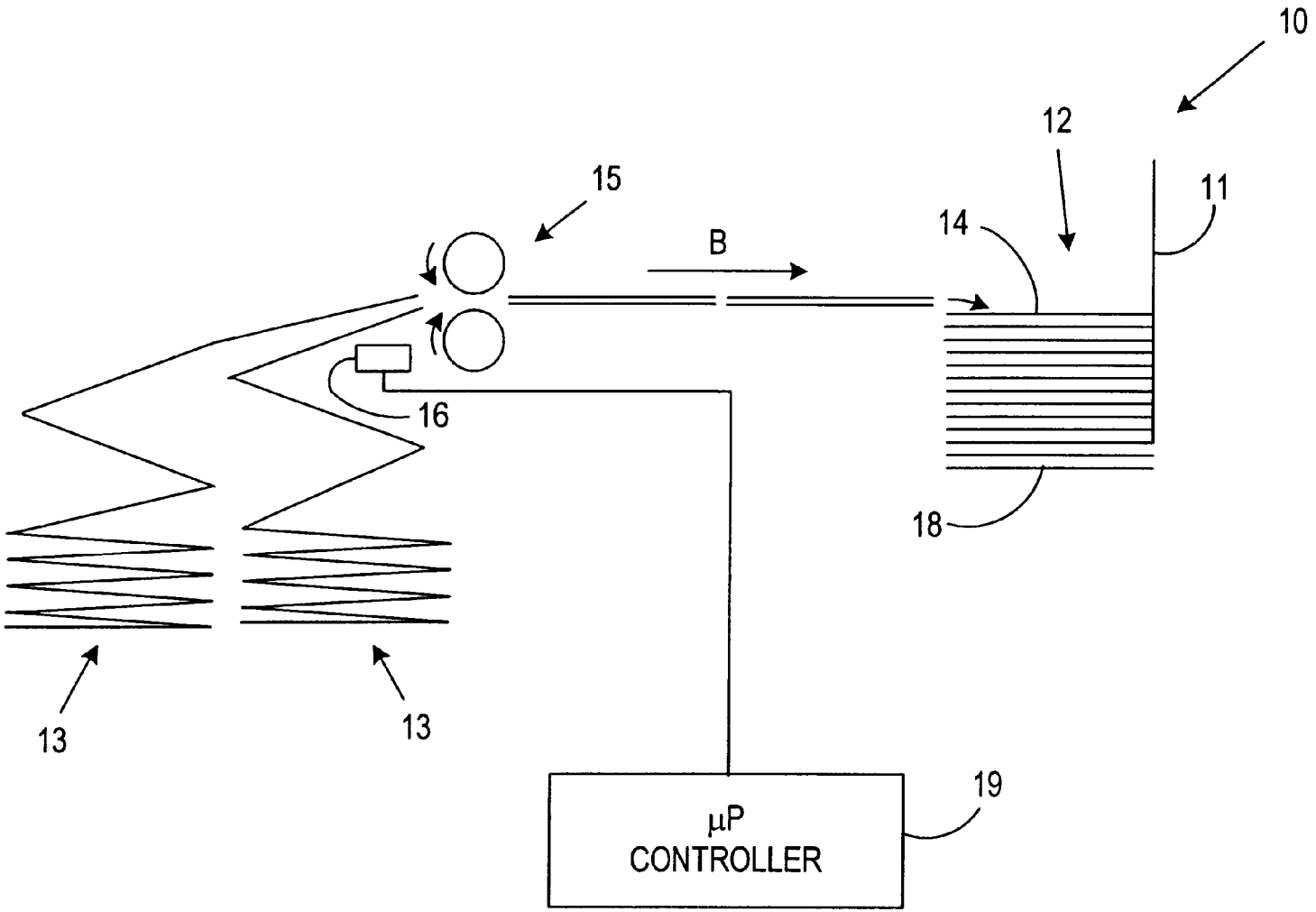
FIG. 4 is a schematic representation of an embodiment of the apparatus of the present invention where the stack is fed from dual web material.

FIG. 4 is a schematic representation of an embodiment of an upstream portion of the apparatus 10 of the present invention where the stack is fed from dual web material 13 and 13'. An advantage of this configuration is that a singular document stream associated with either dual or two-up paper streams can be stacked or sandwiched together so that one cut would produce two sheets that are conveyed to supply stack 12. The apparatus 10 would process document collations as described above in the descriptions of FIGS. 1 and 3.

Figure 5:
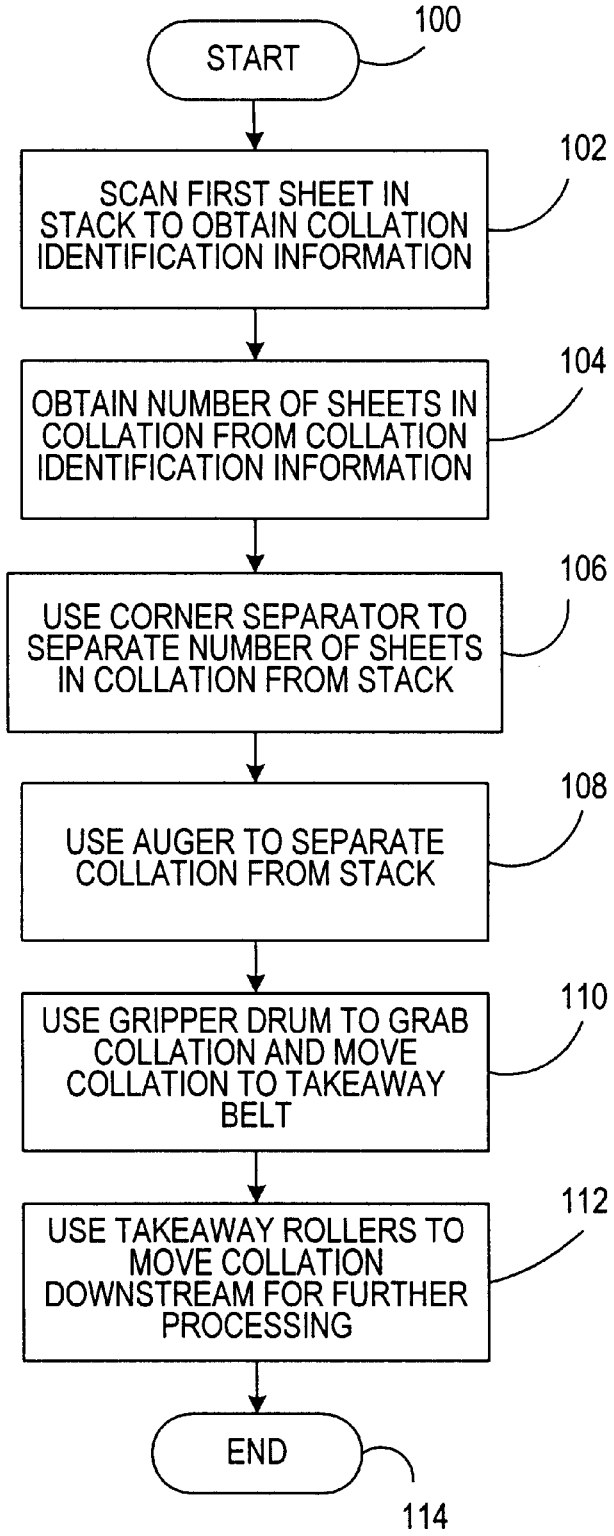
FIG. 5 is a flow chart of a method of the present invention for processing collations from a stack.

FIG. 5 is a flow chart of an embodiment of the method of the present invention. The method could be performed with any of the embodiments described herein. At step 100, the method begins. At step 102, the first sheet 18 in the stack 12 is scanned using scanner 16 to obtain collation identification information. At step 104, from the scanned collation identification information, the number of sheets in the collation is obtained. This collation identification information is processed using microprocessor 19 which sends a signal to the corner separating device 21 to separate the number of sheets 14 in the collation to be formed, from the stack 12. At step 106, the corner separating device 21 separates the corners of the collation sheets from the stack 12. At step 108, the auger collation deflection mechanism 20 biases the leading edge of the entire collation downward after the required number of sheets has been counted and separated (this will effectively identify and separate the first collation from all others). At step 110, the gripper drum 22 is used to move the entire collation to takeaway belts 24. At step 112, the take away belts 24 move the entire collation downstream for further processing such as, for example, folding and insertion.

Figure 6:
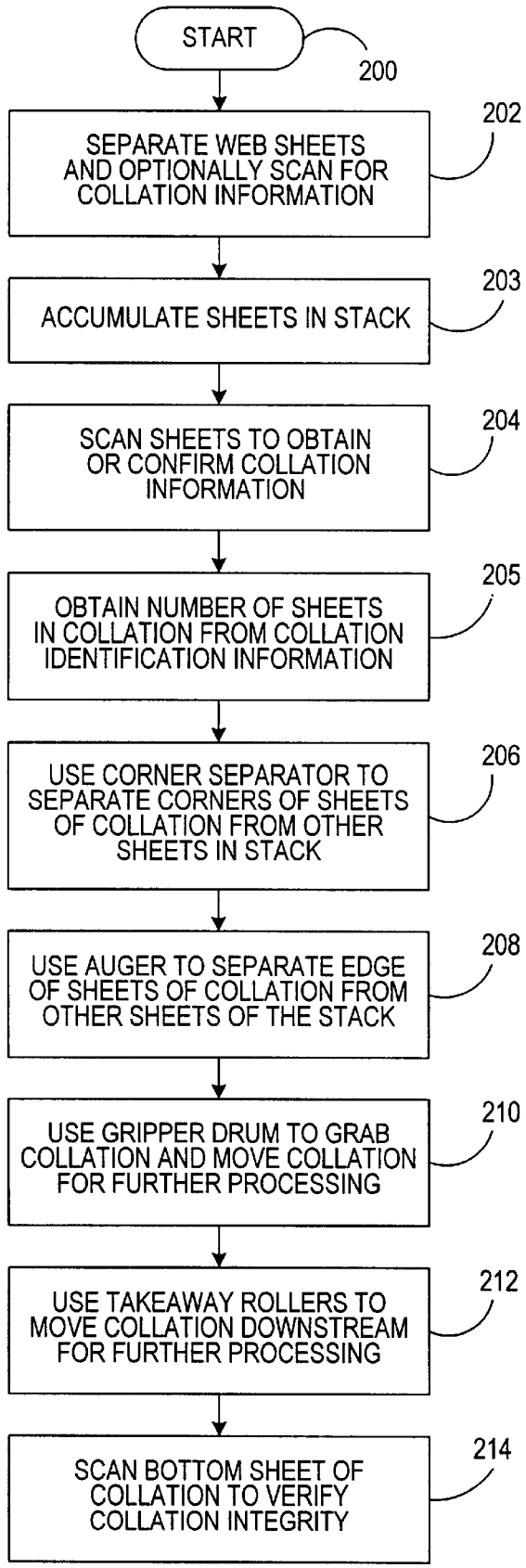
FIG. 6 is a flow chart of a method of the present invention for processing collations from a web.

FIG. 6 is a flow chart of an embodiment of the method of the present invention. The method could be performed with the embodiments described in FIGS. 3 and 4. At step 200, the method begins. At step 202, the sheets of web 13 are separated (cut or burst) and scanned (optional) using scanner 16 to obtain collation identification information. At step 203, the sheets are accumulated in stack tray 11 to form stack 12. At step 204, first sheet of stack 12 is scanned to obtain or verify collation identification information (when optional scanning performed at step 202). At step 205, from the scanned collation identification information, the number of sheets in the collation is obtained. This collation identification information is processed using microprocessor 19 which sends a signal to the corner separating device 21 to separate the number of sheets 14 in the collation to be formed, from the stack 12. At step 206, the corner separating device 21 separates the corners of the collation sheets from the stack 12. At step 208, the auger collation deflection mechanism 20 biases the leading edge of the entire collation downward after the required number of sheets has been counted and separated (this will effectively identify and separate the first collation from all others). At step 210, the gripper drum 22 is used to move the entire collation to takeaway belts 24. At step 212, the take away belts 24 move the entire collation downstream for further processing such as, for example, folding and insertion. At step 214, the bottom sheet of the collation is scanned to verify collation integrity.

In each embodiment of the present invention, a moving beam scanner could be used to read associated codes on first sheet for collation identification/verification purposes. The code could alternatively be read dynamically as the collation is removed from the feed tray.

It should be noted that in the above described embodiments, other positive acquisition and transport devices could be utilized as alternatives to the gripper drum device depicted such as, for example, an assortment of reciprocating camming or gripping mechanisms, gripper chain, D rollers, etc. as may be implemented by one of ordinary skill in the art. It should also be noted that in the above described embodiments, parallel activity can take place during the process schematically described above. For example, after the auger deflection mechanism 20 has separated the leading edge of the first collation from the rest, the corner separation device may then continue to identify and delineate the next collation (even before the first collation has been removed from the stack).

In any of the embodiments described above, scanning may not necessarily be performed in situations where each collation contains the same number of sheets. That is, if for example, each collation contained four sheets, each separation action would separate four sheets from the stack, and those four sheets would be deflected as a collation. The steps would be repeated on the remainder of the stack.

The present invention generates collations at a speed that is fractional compared to processes that require accumulating sheets seriatim to form collations. For example, compared to a machine transporting sheets at a velocity of 360 ips to form four-sheet collations, the present invention, the present invention can form such four-sheet collations at approximately one fourth (¼) the velocity because the collations are taken as a whole from the stack supply.

As can be understood from the previous description, the advantages of the apparatus and method of the present invention are novel compared to conventional sheet separation and processing methods. The present invention provides distinct advantages compared to conventional processing. The present invention can reduce cost, complexity, noise (such as transport noise, drive transmission noise and paper flutter), and unnatural paper motions associated with conventional input processing methods. The distinct advantages of this process will be particularly evident for processing input documents at the rates required by the high-speed inserting system.

Additional advantages and modifications will readily occur to those skilled in the art. Therefore, the invention in its broader aspects is not limited to the specific details and representative devices shown and described herein. Accordingly, various modifications may be made without departing from the spirit or scope of the general inventive concept as defined by the appended claims.

What is claimed is:

1. An apparatus for separating an entire collation of individual sheets from a supply stack for downstream processing comprising:

(a) a supply stack tray, the supply stack tray for containing a plurality of collations comprised of a supply stack of individual sheets;

(b) a separator device for separating all sheets of a collation from corresponding other sheets in the supply stack;

(c) a gripper device positioned proximate to the supply stack of individual sheets for gripping the entire collation after the leading edge of the sheets of the collation have been separated from the other sheets in the supply stack, the gripper device moving the entire collation from the supply stack tray downstream for processing;

(d) a scanner for scanning collation identification information on a first sheet in the supply stack to obtain a number of sheets in the collation; and (e) a microprocessor controller for processing the collation identification information obtained by the scanner and signaling the separation device to separate the number of sheets in the collation from the supply stack.

2. The apparatus as claimed in claim 1 wherein the separator device is a vacuum operated separation device.

3. The apparatus as claimed in claim 1 wherein the gripper device is a gripper drum.

4. An apparatus for separating a collation of individual sheets from a supply stack comprising:

(a) a means for containing a supply stack while collations in the supply stack are being separated;

(b) a separating means adjacent to the means for containing the supply stack for separating each sheet in the collation from the supply stack to form a collation;

(c) a collation separator means for separating the collation after the collation has been separated by the separating means; and (d) a gripper means for gripping the entire collation after the collation has been separated from the stack, and for moving the collation downstream for further processing.

5. A method of separating a collation of individual sheets from a supply stack comprising the steps of:

(a) separating the individual sheets in the collation from other sheets in the supply stack;

(b) gripping the collation in its entirety and moving the collation in its entirety from the supply stack for downstream processing, (c) scanning a sheet in the supply stack to obtain information about a number of sheets in the collation prior to step 7(*a*); and (d) processing the information obtained by scanning in step 7(*c*) and signaling a separating device to separate the number of sheets in the collation.

6. The method as claimed in claim 5 comprising the steps of:

(a) scanning a first sheet in the collation after step 7(*c*) to verify that the first sheet scanned at step 8(*a*) is the first sheet of the collation after the collation has been separated from the supply stack.

7. The method as claimed in claim 6 further comprising the steps of:

(a) processing information about the number of sheets in the collation; and (b) signaling a separating device to separate the number of sheets in the collation.

* * * * *